United States Patent [19]

Selvarajan et al.

[11] Patent Number: 4,744,891

[45] Date of Patent: May 17, 1988

[54] FLOTATION OF APATITE FROM MAGNATITE

[75] Inventors: Radhakrishnan Selvarajan, Oak Park; Richard D. Christie, Downers Grove, both of Ill.

[73] Assignee: NALCO Chemical Company, Naperville, Ill.

[21] Appl. No.: 862,296

[22] Filed: May 12, 1986

[51] Int. Cl.[4] ..... B03D 1/02

[52] U.S. Cl. ..... 209/166; 252/61; 75/2

[58] Field of Search ..... 209/166, 167; 75/2; 252/61

[56] References Cited

U.S. PATENT DOCUMENTS

| | | | |
|---|---|---|---|
| 2,099,120 | 11/1937 | Kirby | 209/166 |
| 2,466,995 | 4/1949 | McMurray | 209/166 |
| 2,525,146 | 10/1950 | McMurray | 209/166 |
| 2,944,666 | 7/1960 | Bunge | 209/166 |
| 3,779,380 | 12/1973 | Bishop | 209/166 |
| 4,034,863 | 7/1977 | Wang | 209/166 |
| 4,081,363 | 3/1978 | Grayson | 209/166 |
| 4,148,720 | 4/1979 | Wang | 209/166 |
| 4,200,522 | 4/1980 | Dorrepaal | 209/166 |
| 4,233,150 | 11/1980 | Wang | 209/166 |
| 4,511,463 | 4/1985 | Alexander | 209/166 |

*Primary Examiner*—Kenneth M. Schor
*Assistant Examiner*—Thomas M. Lithgow
*Attorney, Agent, or Firm*—John G. Premo; Anthony L. Cupoli; Donald G. Epple

[57] ABSTRACT

A beneficiation reagent is provided which is the half-ester reaction product of a short-chain dicarboxylic acid source, such as maleic anhydride, and a saturated, aliphatic, monohydric alcohol containing from eight to thirteen carbon atoms, preferably ten carbon atoms. This reagent is added neat to a water-slurry of iron ore concentrate in an amount of from about 0.1 to about 0.7 pounds/ton.

5 Claims, No Drawings

FLOTATION OF APATITE FROM MAGNATITE

FIELD OF THE INVENTION

This invention relates generally to processes for concentrating the iron ore which is intended to be used in steel-making operations, and more particularly to processes for concentrating magnetite ore for such purposes.

BACKGROUND OF THE INVENTION

The weathering of igneous rock has resulted in the formation of various deposits of iron oxides and carbonates; and these comprise the principal mineral sources of the metal. In addition, the iron oxides and carbonates commonly occur in natural association with such other minerals as sulfides, silicates and phosphates. Moreover, certain steel-making processes require that the iron ore being charged be low in phosphorus because that element is not readily oxidized to an acceptable slag by oxygen-containing gases; and as a consequence, there is reduced marketability for iron ore pellets, for example those based on magnetite ore, which posses a phosphorus content above 0.05% by weight.

Accordingly, in the past, efforts have been made to remove the principal phosphorus-bearing contaminant mineral, apatite, from magnetite ore by using beneficiation procedures. However, the fatty acid-based flotation reagents generally employed heretofore have exhibited poor selectivity, allowing appreciable amounts of iron ore to be floated off with the apatite, thus reducing yields uneconomically.

An important object of the present invention is therefore to provide an improved method of beneficiating magnetite ore concentrate to remove apatite in a highly economical and selective manner.

A more general object of the invention is to provide new and improved methods and reagents for beneficiating iron ore.

Another object of the invention is to provide a self-frothing beneficiation reagent for separating apatite from an iron ore slurry.

BRIEF DESCRIPTION OF THE INVENTION

The objects of the invention are achieved by providing a beneficiation reagent which is the half-ester reaction product of a short-chain dicarboxylic acid source, such as maleic anhydride, and a saturated, aliphatic, monohydric alcohol containing from eight to thirteen carbon atoms, preferably ten carbon atoms. This reagent is added neat to a water-slurry of iron ore concentrate in an amount of from about 0.1 to about 0.7 pounds/ton, conveniently to the slurry line feeding the rougher cells of the flotation machine; and thereafter, the treated slurry is subjected to conventional separation procedures in order to affect removal of phosphate mineral.

DETAILED DESCRIPTION OF THE INVENTION

In brief, the invention includes, a method of beneficiating magnetite iron ore concentrates to remove apatite by flotation which comprises the steps of:

(a) Adding to said concentrates from about 0.1 pounds/ton to about 0.7 pounds/ton of a collector consisting essentially of the half ester of a short-chain dicarboxylic acid or source thereof containing at least four carbon atoms with a saturated aliphatic monohydric alcohol containing from eight to thirteen carbon atoms, (b) Subjecting the thus treated concentrate to a flotation process whereby the apatite is floated from the iron ore contained in the magnetite, and then, (c) Recovering the iron ore.

The half-ester collector reagent of the present invention is synthesized by reacting a source of a short-chain dicarboxylic acid with a stoichiometrically selected amount of a saturated aliphatic alcohol at a suitable temperature, such as about 110° C., and collecting the resultant adduct from the reaction mixture. Maleic anhydride comprises a preferred source of the dicarboxylic acid constituent, although its homologs may also be employed; and the saturated aliphatic alcohol of the invention is selected to be a monohydric alcohol containing from eight to thirteen carbon atoms, preferably ten carbon atoms. Advantageously, the adducts of the present invention have proved to be self-frothing and thus do not require the use and expense of a companion frothing agent. In addition, an optimum combination of performance factors has been observed with the half-ester reaction product of maleic anhydride and n-decanol. The corresponding phthalate ester has exhibited unacceptable activity, and t-butylphenol maleate has produced a barren froth.

In one exemplary synthesis, maleic anhydride briquettes and dodecyl alcohol were selected as the reactants and combined in a weight ratio of 34.3/65.7. The reactants were weighed into a polymerization flask fitted with a thermometer, stirrer, and a condenser which was connected to a bubbler. The mixture was heated to 70° C. without stirring and retained at that temperature for five minutes in order to complete melting of the anhydride briquettes. The mixture was then heated with agitation to a temperature of 110° C.; and rapid mixing was maintained in order to wash down the sublimed anhydride. As the reaction progressed, it was observed that the liquid attained a yellow coloration. After two hours at 110° C., the mixture was cooled, analyzed for the absence of maleic anhydride by infra red techniques, and the reaction product was collected. The end product was determined to have a specific gravity of 8.14 pounds/gallon and a viscosity of 110 centipoises measured on a Brookfield Viscosimeter using the No. 3 spindle at 60 r.p.m.

The half-ester collector reagent of the present invention is used by adding it neat to a water-slurry of an apatite-containing, iron ore concentrate, conveniently to the slurry line feeding the rougher cells of a flotation machine; and advantageous results have been obtained by adding the reagent in an amount of from about 0.1 to about 0.7 pounds/ton and in an absence of air. After the slurry has been treated with the reagent, it is passed first to the rougher cells and then to the cleaner cells, where air is introduced to promote frothing and separation in the manner customarily achieved in a conventional flotation machine, the slurry being thereafter dewatered for subsequent pelletizing.

In order to describe the invention more fully, the following specific examples are given without, however, limiting the invention to the precise details and conditions set forth.

EXAMPLES 1-13

Laboratory evaluation of the effectiveness of various half-ester collector reagents synthesized according to the invention were conducted using a 6-liter Denver cell with the machine operated at 1500 r.p.m. A water-slurry was formed for each run using 1000 grams of dry solids comprising finely pulverized magnetite ore concentrate containing an apatite contaminant. The slurry was first agitated for 30 seconds in the absence of air and then the selected reagent was added neat, the slurry being conditioned for one minute in the absence of air and the mixture thereafter aspirated. Resultant froth was collected for two minutes; and the separated products were thereupon dried, weighed and analyzed. The data set forth in Table I were collected.

TABLE I

Laboratory Evaluation of Collector Reagents with Magnetite Ore Concentrate

| Example No. | Reagent* | Dose (lb/Ton) | Phosphorus (%) Fe conc. | Phosphorus (%) Recovery | Yield (%) |
|---|---|---|---|---|---|
| 1 | $C_{10}$/MA | 0.16 | 0.030 | 53.0 | 8.7 |
| 2 | $C_{10}$/MA | 0.10 | 0.032 | 41.8 | 4.2 |
| 3 | $C_{10}$/MA | 0.13 | 0.029 | 48.5 | 6.6 |
| 4 | $C_{12}$/MA | 0.16 | 0.028 | 53.9 | 9.7 |
| 5 | $C_{12}$/MA | 0.13 | 0.033 | 44.4 | 7.1 |
| 6 | $C_{12}$/MA | 0.10 | 0.035 | 40.5 | 5.4 |
| 7 | $C_{13}$/MA | 0.16 | 0.034 | 39.2 | 4.9 |
| 8 | $C_{13}$/MA | 0.13 | 0.039 | 29.3 | 2.5 |
| 9 | $C_{13}$/MA | 0.19 | 0.030 | 48.6 | 6.9 |
| 10 | Fatty-Acid Based Commercial Reagent | 0.32 | 0.030 | 67.3 | 27.9 |
| 11 | Fatty-Acid Based Commercial Reagent | 0.20 | 0.040 | 37.5 | 5.6 |
| 12 | Fatty-Acid Based Commercial Reagent | 0.10 | 0.046 | 17.1 | 1.3 |
| 13 | $C_{10}$/PA | 0.64 | 0.037 | 33.5 | 3.1 |

*REAGENT ABBREVIATIONS ARE AS FOLLOWS
$C_{10}$/MA - half-ester reaction product of n-decanol and maleic anhydride
$C_{12}$/MA - half-ester reaction product of n-dodecanol and maleic anhydride
$C_{13}$/MA - half-ester reaction product of tridecyl alcohol and maleic anhydride
$C_{10}$/PA - half-ester reaction product of n-decanol and phthallic anhydride As will be seen in Table I, all reagents according to the invention achieved excellent separation of the apatite constituent from the magnetite ore concentrate, the phosphorus levels for all invention reagents at all dosage levels set forth falling in the acceptable range of 0.03–0.04 percent phosphorus, or lower, in the final iron ore concentrate. It should be noted that the high yield in the float of Example 10, employing a commercial fatty acid-based reagent, demonstrates poor selectivity and uneconomical loss of iron from the slurry. In addition, the commercial product, included in the evaluation program for comparison purposes, proved less efficient as a collector, thus requiring higher dosage in order to achieve a given phosphorus target content.

The specific examples herein set forth are to be considered as being primarily illustrative. Various modifications will, no doubt, occur to those skilled in the art; and such modifications are to be understood as forming a part of this invention insofar as they fall within the spirit and scope of the appended claims.

The invention is claimed as follows:

1. A method of beneficiating magnetite iron ore concentrates to remove apatite by flotation which comprises the steps of:

(a) Adding to said concentrates from about 0.1 pounds/ton to about 0.7 pounds/ton of a collector consisting essentially of the half ester of a short-chain dicarboxylic acid or source thereof containing at least four carbon atoms with a saturated aliphatic monohydric alcohol containing from eight to thirteen carbon atoms, (b) Subjecting the thus treated concentrate to a flotation process whereby the apatite is floated from the iron ore contained in the magnetite, and then, (c) Recovering the iron ore.

2. The method according to claim 1 wherein said dicarboxylic acid source is maleic anhydride.

3. The method according to claim 2 wherein said alcohol is n-decanol.

4. The method according to claim 2 wherein said alcohol is n-octanol.

5. The method according to claim 2 wherein said alcohol is n-dodecanol.

* * * * *

UNITED STATES PATENT AND TRADEMARK OFFICE

CERTIFICATE OF CORRECTION

PATENT NO. : 4,744,891

DATED : May 17, 1988

INVENTOR(S) : RADHAKRISHNAN SELVARAJAN & RICHARD D. CHRISTIE

It is certified that error appears in the above-identified patent and that said Letters Patent is hereby corrected as shown below:

TITLE:

FLOTATION OF APATITE FROM MAGNATITE

"LETTERS PATENT SHOULD READ AS:"

FLOTATION OF APATITE FROM MAGNETITE

Signed and Sealed this

Twentieth Day of September, 1988

*Attest:*

DONALD J. QUIGG

*Attesting Officer*

*Commissioner of Patents and Trademarks*